PTH43 XR 4,291,082

[19] Stall

[11] 4,291,082

[45] Sep. 22, 1981

[54] BREATHABLE FABRIC AND SACK MADE THEREFROM

[75] Inventor: Alan D. Stall, Omemee, Canada

[73] Assignee: E. I. Du Pont de Nemours and Company, Wilmington, Del.

[21] Appl. No.: 94,110

[22] Filed: Nov. 14, 1979

[30] Foreign Application Priority Data

Nov. 15, 1978 [GB] United Kingdom ..... 044572/78

[51] Int. Cl.[3] ..... B32B 3/10; B32B 5/20; B65D 29/02

[52] U.S. Cl. ..... 428/138; 139/389; 156/78; 156/244.25; 206/524.2; 229/53; 264/DIG. 8; 428/35; 428/141; 428/196; 428/226; 428/265; 428/315; 428/516

[58] Field of Search ..... 428/138, 141, 196, 226, 428/265, 315, 516, 35; 156/78, 244.25; 139/389; 206/524.2; 229/53; 264/DIG. 8

[56] References Cited

U.S. PATENT DOCUMENTS

| | | | |
|---|---|---|---|
| 2,281,635 | 5/1942 | Strauss | 428/226 |
| 3,300,366 | 1/1967 | Krolis | 264/DIG. 8 |
| 3,439,865 | 4/1969 | Port et al. | 428/226 |
| 3,445,055 | 5/1969 | Port et al. | 428/226 |
| 3,454,455 | 7/1969 | Rasmussen | 428/137 |
| 3,551,267 | 12/1970 | Addison | 206/524.2 |
| 3,644,165 | 2/1972 | Chen | 428/138 |
| 3,700,536 | 10/1972 | Bentvelzen et al. | 428/138 |
| 3,734,812 | 5/1973 | Yazawa | 428/196 |
| 3,762,983 | 10/1973 | Osborn | 156/244.25 |

FOREIGN PATENT DOCUMENTS 909726 9/1972 Canada .

*Primary Examiner*—James C. Cannon

[57] ABSTRACT

A breathable fabric which comprises a structure woven from thermoplastic polymeric tapes, wherein the woven structure is coated with a foamed permeable coating. The tapes are preferably made from polyethylene having a density between 0.940 and 0.970 g/cm$^3$. The coating is preferably a lace coating made from polyethylene having a density between 0.910 and 0.940 g/cm$^3$. The fabric is useful for making breathable sacks.

13 Claims, 1 Drawing Figure

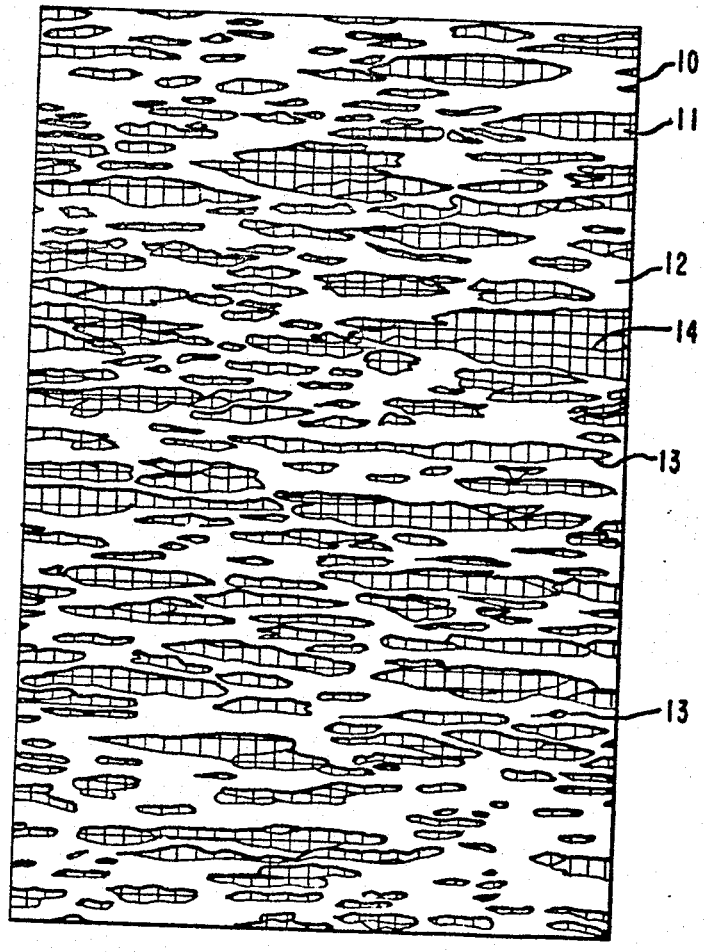
10
11
12
14
13
13

BREATHABLE FABRIC AND SACK MADE THEREFROM

BACKGROUND OF THE INVENTION

The present invention relates to a breathable woven fabric of thermoplastic polymeric tapes and sacks made thereform. The term "breathable" refers to the ability of the fabric to allow gases and moisture to pass freely through the fabric.

Breathable woven fabrics are useful in packaging applications, particularly for making sacks intended to contain finely divided solid agricultural products such as seed.

Woven tape structures have previously been prepared from oriented tapes of polypropylene or polyethylene. Structures of this type may exhibit a tendency to unravel or the weave may tend to distort, both of which may affect the utility of the woven structure in some end uses. Techniques have previously been suggested for the stabilization of such woven structures. For example, the use of coatings is described in Luckenhaus, British Pat. No. 1,185,553.

For some applications, however, it is desirable to retain the breathable nature of an uncoated woven fabric, for example, when the fabric is used for agricultural sacks or tarpaulins. One method for obtaining a breathable sack disclosed in Overton, Canadian Pat. No. 909,726 involves inserting a plastic liner, punctured with a plurality of small holes, into a sack woven from oriented plastic tapes. In general, however, such methods are commercially inefficient.

For packaging granular or finely divided solids e.g., fertilizer or seed, in sacks of woven structures it is desirable not only to provide a sack which is breathable but also to ensure that the weave of the structures is stable and does not exhibit a tendency to open.

Techniques for stabilization of woven structures are shown in Poole, U.S. Pat. No. 3,951,050 in which tubes of woven structures, made from polyethylene tapes, are coated with a thin layer of polyethylene. Other techniques, which retain the breathable nature of the structure, for example, by use of an adhesive, are described in Foster, U.S. Pat. No. 2,521,055. Such techniques, however, tend to be expensive or require facilities in addition to the weaving and coating facilities normally available to manufacturers of fabric woven from thermoplastic polymeric tapes.

SUMMARY OF THE INVENTION

The present invention provides a breathable fabric having a stable weave.

Specifically, the present invention provides a fabric comprising a structure woven from thermoplastic polymeric tapes, said structure having a foamed permeable coating bonded to at least one side thereof. Preferably, the coating is a synthetic thermoplastic polymeric lace.

The present invention also provides a process for making a breathable fabric comprising extruding a coating of a synthetic thermoplastic polymer onto and bonding the coating to a woven structure of synthetic thermoplastic polymeric tapes, wherein the coating material contains a blowing agent in an amount sufficient to make the coating porous.

The present invention further provides a breathable sack made from a fabric of the present invention.

BRIEF DESCRIPTION OF THE FIGURE

The FIGURE is a schematic representation of a woven structure of the present invention.

DETAILED DESCRIPTION OF THE INVENTION

The woven fabric used in the present invention is prepared from thermoplastic polymeric tapes. Those tapes prepared from polypropylene and polyethylene are preferred, and especially those of polyethylene having a density between 0.940 and 0.970 g/cc.

In accordance with the present invention, at least one side of the woven structure has bonded thereto a foamed permeable coating. The coating can be prepared from polyethylenes and polypropylenes. Preferably, the coating is a lace of synthetic thermoplastic polymeric material capable of melt extrusion. The material comprising the lace coating should cover between about 10 and 90 percent, and especially between about 30% to 70% of the side of the woven structure to which the coating is bonded.

When polyethylene is used for the coating material, the density, prior to coating the woven structure, is preferably 0.910 to 0.965 g/cc, especially 0.910 to 0.940 g/cc. It will be appreciated by those skilled in the art that polyethylenes having a density in the range of 0.910 to 0.940 g/cc are somewhat easier to apply as a coating than polyethylenes having higher density. However, some polyethylenes having a density in the range of 0.940 to 0.960 g/cc have recently been developed which are equally suitable for coating and may be used at production rates approaching those of the lower density polyethylenes.

In those embodiments of the invention where the woven structure is made from polypropylene, the coating polymer is selected from homopolymers and copolymers of propylene.

The woven structures of the present invention are prepared by extruding a coating of the synthetic thermoplastic polymer onto the woven structure of synthetic thermoplastic polymeric tapes, simultaneously bonding the coating to the woven structure, wherein the coating material contains a blowing agent in an amount sufficient to make the coating porous. Blowing agents which can be used are preferably selected from the group consisting of zinc carbonate, sodium bicarbonate, hydrated alumina and azodicarbonamide. In a particularly preferred embodiment, zinc carbonate is used as the blowing agent in a concentration of about 2% by weight of a coating material.

Preferably, the coating process comprises extruding a web of the coating material from a stationary slot die onto a web of the woven structure travelling beneath and tranversly to the direction of extrusion of the web of coating material. In a particularly preferred process, the temperature of extrusion, the amount of blowing agent, the distance between the die and the woven web, and the rate of travel of the woven web are adjusted to provide a coating which is a lace coating having weight between about 12 and 70 g/cm$^2$ of woven structure. The lace coated structure may be made by extruding low density polyethylene having about 20 grams of blowing agent per killigram of polyethylene, at a temperature of between about 200° C. and 400° C. onto a longitudinally travelling web of woven high density polyethylene tape structure.

Referring to the drawing, the lace coated structure 10 comprises a woven structure 11 of high density polyethylene warp and weft tapes coated with a lace coating 12 of low density polyethylene. The holes 13 in the lace coating may give the fabric the appearance of having a fibrillated film coated thereon or the holes may be somewhat elongated and clearly defined. In the embodiment shown in the drawing, the holes are reasonably well defined, but many holes have "strings" of low density polyethylene 14 within the holes.

The coated breathable woven structures of the present invention can be formed into sacks by conventional stitching or heat sealing techniques. The choice of coating materials may depend on factors such as the slip resistance of the outer surface of the sack, the heat sealibility of the fabric and ease of coating the woven structure, among other things.

The following examples serve to illustrate the present invention.

EXAMPLE 1

A 33 cm wide web of woven high density polyethylene tapes was transported from a supply beam, past an extrusion coater, having a 0.5 mm wide extrusion die 36 cm in length, and a 1 m wide chill roll and subsequently wound up on a wind-up beam. The woven structure was made from 2.8 mm wide tapes, with 36 ends per 100 centimeters and 28 picks per 10 centimeters. The web was transported past the extrusion coater at a speed of 61 m/min. The coating travelled in an unsupported condition a distance of about 15 cm between the die lip and the web.

Low density polyethylene resin having 20 grams of zinc carbonate blowing agent per kilogram of polyethylene was extruded through the die at a rate of 39 kg/hr, and at a temperature of 310° C. The woven web thus coated was passed over the chill roll which was maintained at a temperature of 15° C. The woven web so processed had a lace coating about 66 μm in thickness with a standard deviation of about 23 μm. The coverage of the woven web by the low density polyethylene was about half i.e., about half of the area of the coating had holes therethrough.

The lace coated fabric so formed was breathable, as shown by the following porosity test:

Air was introduced into a 9.5 cm internal diameter pipe which was open at one end. The air flow was controlled until the velocity of air exiting from the open end of the pipe was 42.7 m/min. A sample of the coated fabric was clamped over the open end of the pipe and the air flow passing through the fabric was measured. The air flow through the fabric of Example 1 was between about 26.0 and 33.5 m/min. This compares with an air flow of between about 36.5 and 38.0 m/min. through a similar but uncoated structure of woven high density polyethylene tapes.

EXAMPLE 2

The procedure of Example 1 was repeated except that the speed of transporting the woven web past the extrusion die and the rate of application of the coating were altered. At 122 m/min. the coverage of the woven web by the coating was about three quarters i.e., about one quarter of the area of the coating had holes therethrough.

I claim:

1. A breathable fabric comprising a structure woven from synthetic thermoplastic polymeric tapes, said structure having a foamed porous lace-like coating of synthetic thermoplastic polymeric material bonded to at least one side thereof.

2. A fabric according to claim 1 wherein the thermoplastic polymeric tapes are made from a polymer selected from the group consisting of polypropylene and polyethylene.

3. A fabric according to claim 2 wherein the thermoplastic polymeric tapes are made from polyethylene having a density between 0.940 and 0.970 g/cm$^3$.

4. A breathable fabric comprising a structure woven from tapes of polyethylene having a density between 0.940 and 0.970 g/cm$^3$, said structure having a foamed porous lace-like coating of polyethylene bonded to at least one side thereof.

5. A fabric according to claim 4 wherein the density of the polyethylene used for coating is between 0.910 and 0.960 g/cm$^3$, prior to coating the structure.

6. A fabric according to claim 5 wherein the density of the polyethylene used for coating is between 0.910 and 0.940 g/cm$^3$, prior to coating the structure.

7. A fabric according to claim 1 or 4 wherein the coating is a lace-like coating in which the material comprising the lace-like coating covers between 10 and 90% of the side of the structure to which the coating is bonded.

8. A fabric according to claim 1 or 4 wherein the coating is a lace-like coating in which the material comprising the lace-like coating covers between 30 and 70% of the side of the structure to which the coating is bonded.

9. A process for making a breathable fabric comprising melt extruding a coating of a synthetic thermoplastic polymer onto and bonding the coating to a woven structure of synthetic polymeric tapes, wherein the coating material contains a blowing agent in an amount sufficient to make the coating into a porous lace-like layer upon extrusion.

10. A process according to claim 11 wherein a web of the coating material is extruded from a stationary slot die onto a web of the woven structure travelling beneath and transversely to the direction of extrusion of the web of coating material.

11. A process according to claim 10 wherein the temperature of extrusion, the amount of blowing agent, the distance between the die and the woven structure, and the rate of travel of the woven structure are adjusted to such an extent that the coating thus formed is a lace-like coating having a coating weight between about 12 and 70 g/cm$^2$ of the woven structure.

12. A process according to claim 11 wherein the coating material containing the blowing agent is polyethylene having a density between 0.910 and 0.960 g/cm$^3$ prior to extrusion, and the woven structure is made from tapes of polyethylene.

13. A process according to claim 12 wherein the blowing agent is selected from the group consisting of zinc carbonate, sodium bicarbonate, hydrated alumina, and azodicarbonamide.

* * * * *

UNITED STATES PATENT AND TRADEMARK OFFICE

CERTIFICATE OF CORRECTION

PATENT NO. : 4,291,082

DATED : September 22, 1981

INVENTOR(S) : Alan D. Stall

It is certified that error appears in the above—identified patent and that said Letters Patent is hereby corrected as shown below:

On the printed face sheet of the patent, the Assignee reading "E. I. DU PONT DE NEMOURS AND COMPANY, WILMINGTON, DEL." should read --Du Pont Canada Inc., Montreal, Canada--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*